US005472102A

United States Patent [19]

Clayton

[11] Patent Number: 5,472,102

[45] Date of Patent: Dec. 5, 1995

[54] PORTABLE CURTAIN ROD SUPPORT

[76] Inventor: Carrie M. Clayton, 7306 Long Canyon Trail, Dallas, Tex. 75249

[21] Appl. No.: 260,261

[22] Filed: Jun. 14, 1994

[51] Int. Cl.[6] ..... A47F 5/00

[52] U.S. Cl. ..... 211/123; 160/350; 211/105.2; 211/105.3; 211/206; 248/265

[58] Field of Search ..... 211/105.1, 105.2, 211/105.3, 123, 204, 206, 207, 175; 248/297.2, 261, 265; 160/350, 351

[56] References Cited

U.S. PATENT DOCUMENTS

| | | | |
|---|---|---|---|
| 443,133 | 12/1890 | Connelly | 160/350 X |
| 1,015,448 | 1/1912 | Madden | 211/206 X |
| 2,980,382 | 4/1961 | Trais | 248/265 |
| 4,323,034 | 4/1982 | Carlson | 248/297.2 X |
| 4,418,882 | 12/1983 | Waring | 248/265 |
| 4,961,296 | 10/1990 | Morehouse | 248/261 X |
| 5,421,394 | 6/1995 | Forrest | 211/123 X |

FOREIGN PATENT DOCUMENTS

| | | | |
|---|---|---|---|
| 185385 | 5/1907 | Germany | 160/350 |

*Primary Examiner*—Robert W. Gibson, Jr.

[57] ABSTRACT

A curtain rod support for supporting a curtain rod and associated curtain proximate a window. The inventive device includes a pair of vertically adjustable stanchions each supported by a weighted base for positioning on laterally opposed sides of a window. An adjustable transverse support extends between the upper distal ends of the stanchions and includes a pair of mounting plates for mounting a curtain rod therebetween. The support permits a rapid installation of curtains or drapes to a window without modification of the surrounding window structure, thereby enabling apartment dwellers or renters to removably install such curtains.

7 Claims, 3 Drawing Sheets

52
3
44
40
42
52
30
30
5
12
14
22
16
22
2
2

12
22
28
24
18
20
26

PORTABLE CURTAIN ROD SUPPORT

BACKGROUND OF THE INVENTION

1. Field of the Invention

The present invention relates to curtain rods and more particularly pertains to a portable curtain rod support for supporting a curtain rod and associated curtain proximate a window.

2. Description of the Prior Art

The use of curtain rods is known in the prior art. More specifically, curtain rods heretofore devised and utilized for the purpose of supporting curtains proximate a window are known to consist basically of familiar, expected and obvious structural configurations, notwithstanding the myriad of designs encompassed by the crowded prior art which have been developed for the fulfillment of countless objectives and requirements.

For example, a portable curtain rod support is illustrated in U.S. Pat. No. 3,994,463 for supporting curtains or drapes about a window which eliminates the necessity of nails, screws, or other fasteners to be engaged to the frame work of the window. The assembly includes two poles fitted with threaded ends for adjusting to a length which are set vertically in the frame of a window, and two brackets which may each be clamped along the length of a pole for mounting a curtain or drape rod therebetween.

Another patent of interest is U.S. Pat. No. 3,434,685 which discloses a slidable support for window coverings such as curtains, drapes, Venetian blinds, or the like having relatively vertical sliding tracks adapted to be attached to window frames and to support the window covering, whereby the window covering may be lowered into lower reach or locked into proper position.

Other known prior art patents include U.S. Pat. Nos. 3,111,723; 3,730,469; and 3,224,429.

While these devices fulfill their respective, particular objectives and requirements, the aforementioned patents do not disclose a portable curtain rod support for supporting a curtain rod and associated curtain proximate a window which includes a pair of vertically adjustable stanchions each supported by a weighted base for positioning on laterally opposed sides of a window, with an adjustable transverse support extending between the upper distal ends of the stanchions and having a pair of mounting plates for mounting a curtain rod therebetween.

In these respects, the portable curtain rod support according to the present invention substantially departs from the conventional concepts and designs of the prior art, and in so doing provides an apparatus primarily developed for the purpose of supporting a curtain rod and associated curtain proximate a window.

SUMMARY OF THE INVENTION

In view of the foregoing disadvantages inherent in the known types of curtain rods now present in the prior art, the present invention provides a new portable curtain rod support construction wherein the same can be utilized for supporting a curtain rod and associated curtain proximate a window. As such, the general purpose of the present invention, which will be described subsequently in greater detail, is to provide a new portable curtain rod support apparatus and method which has many of the advantages of the curtain rods mentioned heretofore and many novel features that result in a portable curtain rod support which is not anticipated, rendered obvious, suggested, or even implied by any of the prior art curtain rods, either alone or in any combination thereof.

To attain this, the present invention generally comprises a curtain rod support for supporting a curtain rod and associated curtain proximate a window. The inventive device includes a pair of vertically adjustable stanchions each supported by a weighted base for positioning on laterally opposed sides of a window. An adjustable transverse support extends between the upper distal ends of the stanchions and includes a pair of mounting plates for mounting a curtain rod therebetween. The support permits a rapid installation of curtains or drapes to a window without modification of the surrounding window structure, thereby enabling apartment dwellers or renters to removably install such curtains.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable curtain rod support apparatus and method which has many of the advantages of the curtain rods mentioned heretofore and many novel features that result in a portable curtain rod support which is not anticipated, rendered obvious, suggested, or even implied by any of the prior art curtain rods, either alone or in any combination thereof.

It is another object of the present invention to provide a new portable curtain rod support which may be easily and efficiently manufactured and marketed.

It is a further object of the present invention to provide a new portable curtain rod support which is of a durable and reliable construction.

An even further object of the present invention is to provide a new portable curtain rod support which is susceptible of a low cost of manufacture with regard to both materials and labor, and which accordingly is then susceptible of low prices of sale to the consuming public, thereby making such portable curtain rod supports economically available to the buying public.

Still yet another object of the present invention is to provide a new portable curtain rod support which provides in the apparatuses and methods of the prior art some of the advantages thereof, while simultaneously overcoming some of the disadvantages normally associated therewith.

Still another object of the present invention is to provide a new portable curtain rod support for supporting a curtain rod and associated curtain proximate a window.

Yet another object of the present invention is to provide a new portable curtain rod support which includes a pair of vertically adjustable stanchions each supported by a weighted base for positioning on laterally opposed sides of a window, with an adjustable transverse support extending between the upper distal ends of the stanchions and including a pair of mounting plates for mounting a curtain rod therebetween.

Even still another object of the present invention is to provide a new portable curtain rod support which permits a rapid installation of curtains or drapes to a window without modification of the surrounding window structure, thereby enabling apartment dwellers or renters to removably install such curtains.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
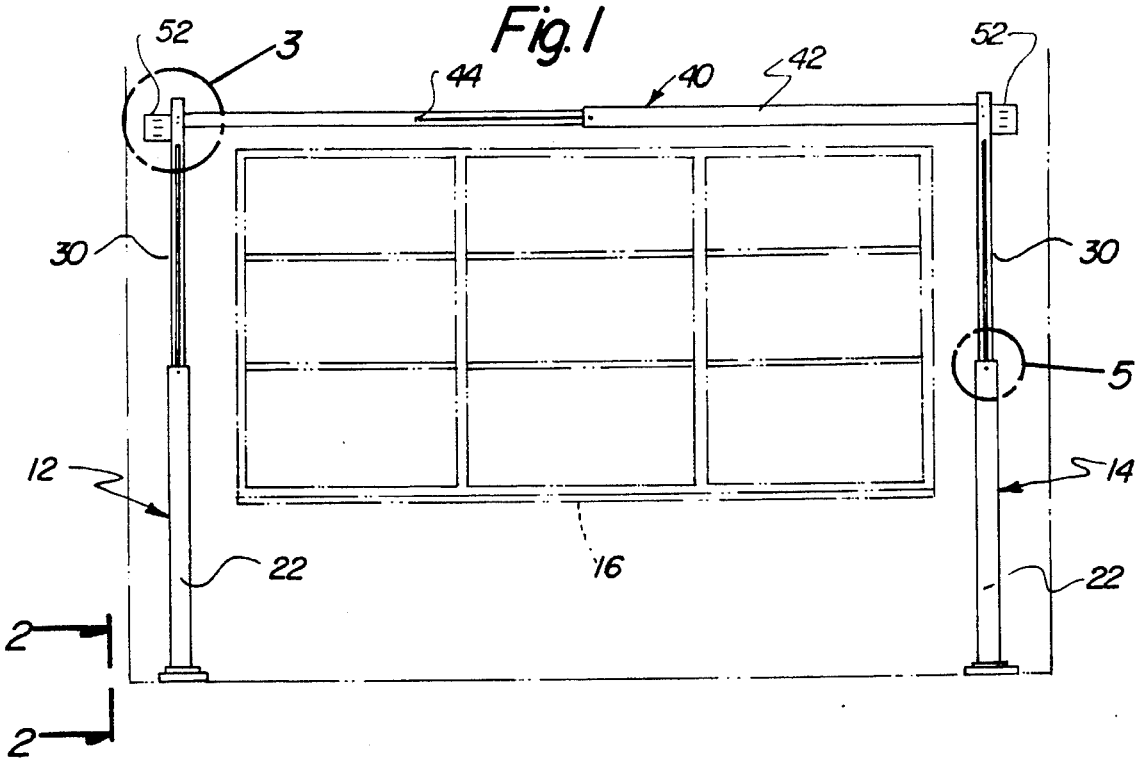
FIG. 1 a front elevation view of a portable curtain rod support comprising the present invention as positioned proximate a window.

With reference now to the drawings, and in particular to FIGS. 1–6 thereof, a new portable curtain rod support embodying the principles and concepts of the present invention and generally designated by the reference numeral 10 will be described.

Figure 2:
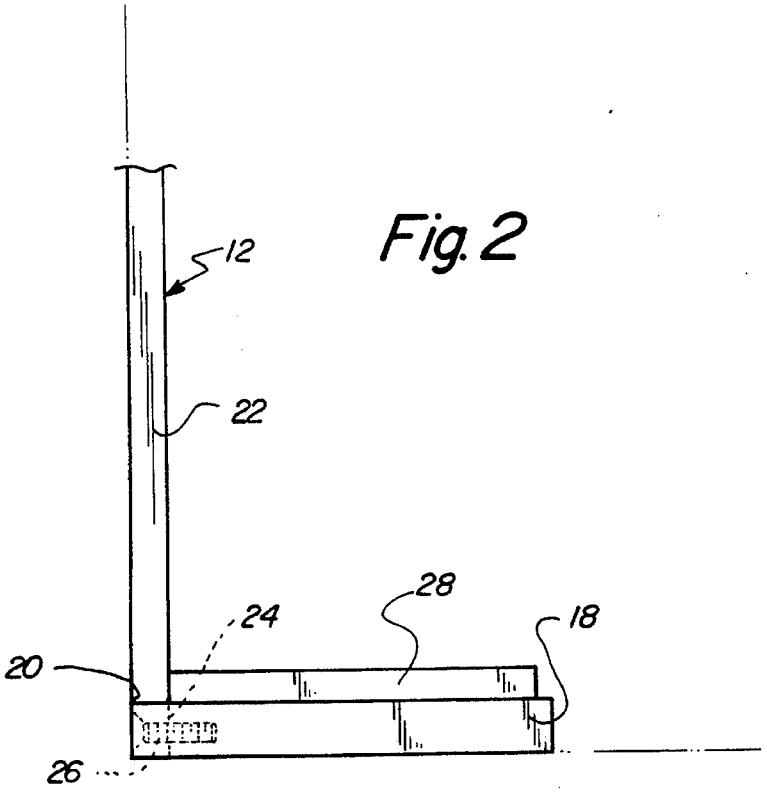
FIG. 2 an enlarged side elevation illustration as viewed from line 2—2 of FIG. 1.

More specifically, it will be noted that the portable curtain rod support 10 comprises a first stanchion 12 and a second stanchion 14 which may be positioned on laterally opposed sides of a window 16, as illustrated in FIG. 1 for example. The stanchions 12, 14 are substantially similar in design and construction and each include a weighted base 18 having a rear side wall 20, as illustrated in FIG. 2. The stanchions 12, 14 each comprise a lower member 22 which is mounted within a journal 24 formed in the rear side wall 20 of the weighted base 18 by a screw 26 which extends through a lower distal end of the lower member 22 and threadably engages the base. Because the lower member 22 is positioned within the journal 24, only a single screw 26 is needed to secure the lower member to the weighted base 18, thereby permitting rapid disassembly of the weighted base from each of the stanchions 12, 14 during transportation and storage of the device 10. The weighted base 18 further includes a top reinforcing member 28 which precludes unintentional pivoting of the lower member 22 relative to the base 18, thereby further rigidifying the journaled connection between the lower member and the base.

Figure 5:
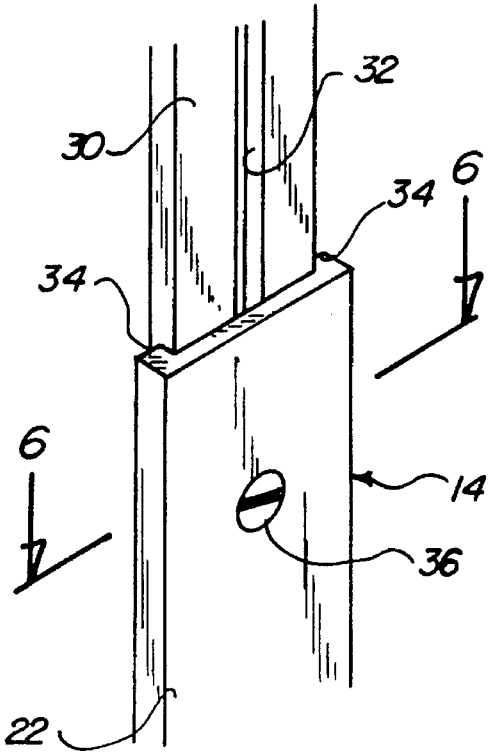
FIG. 5 is an enlarged isometric view of the area set forth in FIG. 1.
Figure 6:
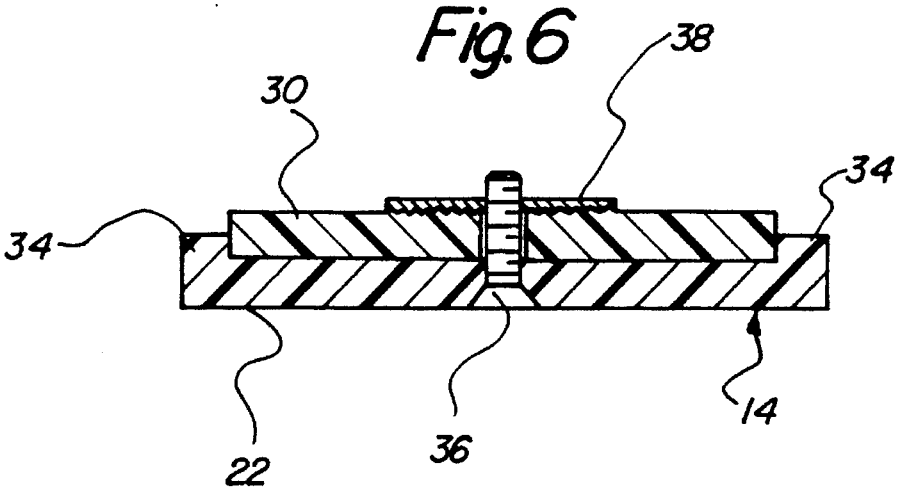
FIG. 6 is a cross sectional view taken along line 6—6 of FIG. 5.

Turning now to FIGS. 5 and 6, it can be shown that the first and second stanchions 12, 14 further comprise an upper member 30 having a longitudinally extending slot 32 which is slidably coupled to the lower member 22, thereby permitting vertical adjustment of the stanchions. To this end, the lower members 22 each include a pair of rearwardly extending lateral alignment flanges 34 which flank the upper member 30 when the upper and lower members are positioned in a sliding, facing relationship, as illustrated in FIG. 6. The lateral alignment flanges 34 are operable to preclude pivoting of the upper member 30 relative to the lower member 22, while simultaneously permitting sliding, longitudinal, relative movement therebetween. To secure the upper member 30 in a desired position relative to the lower member 22, an adjustment fastener 36 extends through an unlabelled aperture in the lower member 22, and through the slot 32 of the upper member to threadably engage a gripping member 38, whereby the adjustment fastener 36 may be loosened or tightened relative to the gripping member 38 to respectively permit or preclude sliding movement of the upper member 30 relative to the lower member 22. To enhance engagement of the gripping member 38 against the upper member 30, the gripping member preferably comprises a rigid metal plate having a plurality of engaging teeth, as illustrated in FIG. 6.

Figure 3:
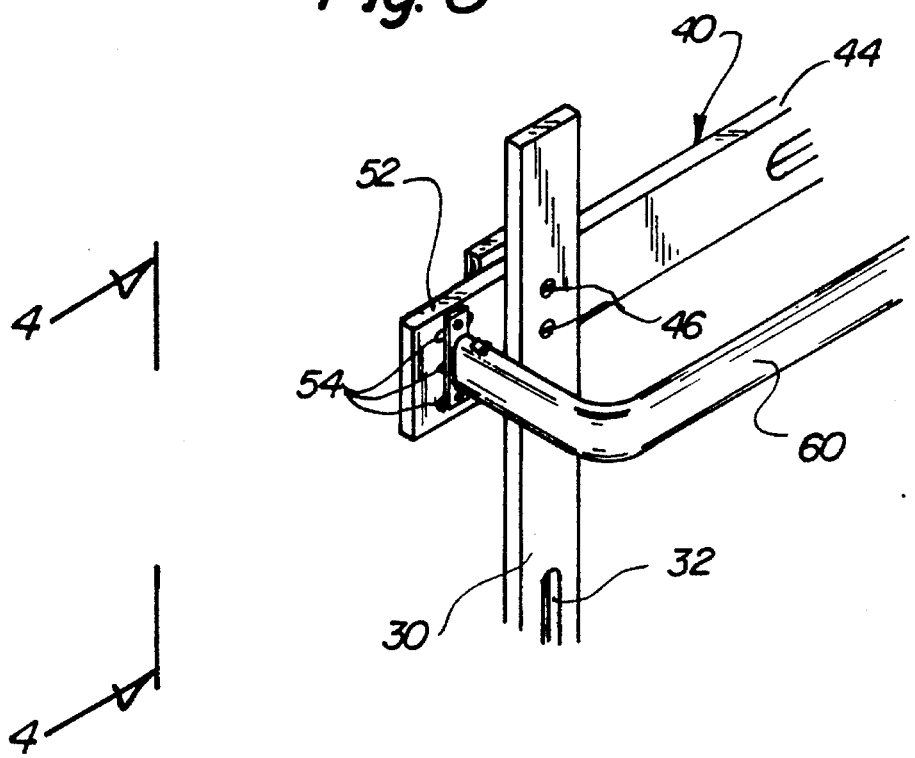
FIG. 3 an enlarged isometric illustration of the area set forth in FIG. 1.
Figure 4:
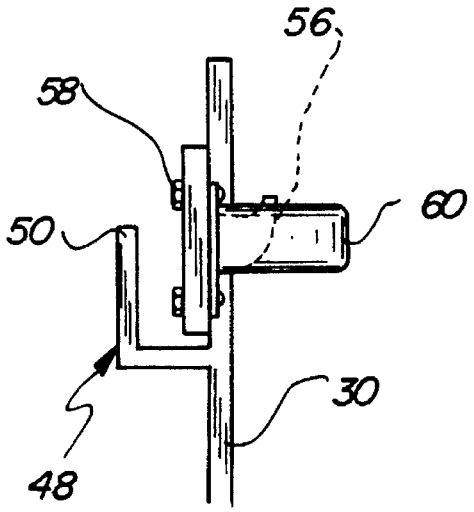
FIG. 4 is a side elevation illustration as viewed from line 4—4 of FIG. 3.

Referring now to FIGS. 3 and 4 with concurrent reference to FIG. 1, it can be shown that the portable curtain rod support 10 further comprises an adjustable transverse support 40 which extends between the upper distal ends of the upper members 30 of both the first and second stanchions 12, 14. The transverse support 40 comprises a first transverse member 42 slidably coupled to a second transverse member 44 in a manner substantially identical to that as illustrated in FIG. 6 for the stanchions 12, 14. Thus, the first transverse member 42 include a pair of unlabelled lateral alignment flanges which flank the second transverse member 44, with an unlabelled adjustment fastener extending through both the first transverse member and an elongated slot in the second transverse member 44 to engage an unlabelled gripping member. Thus, the transverse support 40 may be adjusted to accommodate various widths of windows 16.

With further reference to FIGS. 3 and 4, it can be shown that the transverse members 42, 44 of the transverse support 40 are joined to upper distal ends of the upper members 30 by at least one mounting fastener 46 which extends through apertures in both the transverse members and the upper members. To facilitate ease of installation of the transverse support 40 to the first and second stanchions 12, 14, an installation support means 48 is provided for supporting the transverse support relative to the stanchions prior to installation of the mounting fasteners 46. To this end, the installation support means 48 comprises a substantially L-shaped member 50 secured to a rear face of each of the upper members 30 proximate to the upper distal ends thereof, as illustrated in FIG. 4 for example.

The transverse support 40 terminates at outboard ends of both the first transverse member 42 and the second transverse member 44 in a mounting plate 52 having a plurality of slots 54 extending therethrough which permit the installation of various curtain rod bracketry thereto, such as the curtain rod mount 56 illustrated in FIG. 4. Such bracketry may be attached by threaded fasteners 58 which extend both through the curtain rod mount 56 and the slots 54 in the mounting plate 52. The mounting plates 52 extend outwardly past the stanchions 12, 14, such that curtains or drapes hung a curtain rod 60 extending between the mounting plates will effectively conceal or hide the stanchions.

In use, the portable curtain rod support 10 may be easily erected proximate a window, whereby curtain rod bracketry may be removably coupled to the mounting plates 52 to support the curtain rod 60 and the associated drapes or curtains .in front of the window. Because of its collapsible construction, the portable curtain rod support 10 permits a rapid installation of curtains or drapes to a window without modification to the surrounding window structure, thereby enabling apartment dwellers or renters to removably install such curtains or drapes. Further, the present invention 10 should not be limited to suspending just curtains or drapes, but may also be utilized for suspending beads, sheer blinds, Venetian blinds, vertical blinds, or any other conceivable window coverings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new portable curtain rod support comprising:

a first adjustable stanchion;

a second adjustable stanchion;

a first weighted base for supporting said first stanchion in a vertical position against a wall;

a second weighted base for supporting said second stanchion in a vertical position against said wall; and, an adjustable transverse support coupled to upper distal ends of said stanchions members and extending therebetween, said transverse support including a first mounting plate positioned at a first outboard end thereof, and a second mounting plate positioned at a second outboard end thereof, said mounting plates each having a plurality of slots extending therethrough for mounting a curtain rod mount thereto.

2. The new portable curtain rod support of claim 1, wherein said first adjustable stanchion comprises a first lower member, and a first upper member having a longitudinally extending slot, the first upper member being slidably positioned in a facing relationship to said first lower member, said first lower member having an aperture extending therethrough, with a first adjustment fastener projecting through said aperture and said slot to engage a first gripping member, said first gripping member having teeth which engage said first upper member upon a tightening of said first adjustment fastener, said first lower member including a pair of rearwardly extending lateral alignment flanges which flank the first upper member to preclude rotation of said first upper member relative to said first lower member; and said second adjustable stanchion comprises a second lower member, and a second upper member having a longitudinally extending slot, the second upper member being slidably positioned in a facing relationship to said second lower member, said second lower member having a second aperture extending therethrough, with an adjustment fastener projecting through said aperture and said slot to engage a second gripping member, said second gripping member having teeth which engage said second upper member upon a tightening of said second adjustment fastener, said second lower member including a pair of rearwardly extending lateral alignment flanges which flank the second upper member to preclude rotation of said second upper member relative to said second lower member.

3. The new portable curtain rod support of claim 2, wherein said first weighted base includes a rear side wall with a vertically extending journal formed in the rear side wall thereof, with the first lower member being received and secured within said journal of said first base; and said second weighted base includes a rear side wall with a vertically extending journal formed in the rear side wall thereof, with the second lower member being received and secured within said journal of said second base.

4. The new portable curtain rod support of claim 3, wherein said transverse support is coupled to upper distal ends of said upper members of said stanchions, said transverse support comprising a first transverse member slidably coupled to a second transverse member, with the first transverse member including a pair of lateral alignment flanges which flank the second transverse member, with a transverse support adjustment fastener extending through both the first transverse member and an elongated slot in the second transverse member to engage a transverse support gripping member, said transverse support gripping member having teeth which engage said second transverse member upon a tightening of said transverse support adjustment fastener, with the first mounting plate being positioned at an outboard end of said first transverse member, and the second mounting plate being positioned at an outboard end of said second transverse member.

5. A new portable curtain rod support comprising:

a first stanchion comprising a first lower member, and a first upper member having a longitudinally extending slot, the first upper member being slidably positioned in a facing relationship to said first lower member, said first lower member having an aperture extending therethrough, with a first adjustment fastener projecting through said aperture and said slot to engage a first gripping member, said first gripping member having teeth which engage said first upper member upon a tightening of said first adjustment fastener, said first lower member including a pair of rearwardly extending lateral alignment flanges which flank the first upper member to preclude rotation of said first upper member relative to said first lower member;

a second stanchion comprising a second lower member, and a second upper member having a longitudinally extending slot, the second upper member being slidably positioned in a facing relationship to said second lower member, said second lower member having a second aperture extending therethrough, with an adjustment fastener projecting through said aperture and said slot to engage a second gripping member, said second gripping member having teeth which engage said second upper member upon a tightening of said second adjustment fastener, said second lower member including a pair of rearwardly extending lateral alignment flanges which flank the second upper member to preclude rotation of said second upper member relative to said second lower member;

a first weighted base having a rear side wall with a vertically extending journal formed in the rear side wall thereof, with the first lower member being received and secured within said journal of said first base;

a second weighted base having a rear side wall with a vertically extending journal formed in the rear side wall thereof, with the second lower member being received and secured within said journal of said second base;

a transverse support coupled to upper distal ends of said upper members and extending therebetween, said transverse support comprising a first transverse member slidably coupled to a second transverse member, with the first transverse member including a pair of lateral alignment flanges which flank the second transverse member, with a transverse support adjustment fastener extending through both the first transverse member and an elongated slot in the second transverse member to engage a transverse support gripping member, said transverse support gripping member having teeth which engage said second transverse member upon a tightening of said transverse support adjustment fastener, the transverse support further including a first mounting plate positioned at an outboard end of said first transverse member, and a second mounting plate positioned at an outboard end of said second transverse member, said mounting plates each having a plurality of slots extending therethrough;

a pair curtain rod mounts, each of said mounts being coupled to an individual one of said mounting plates;

a curtain rod extending between said curtain rod mounts for mounting a curtain thereover.

6. The new portable curtain rod support of claim 5, and further comprising an installation support means for supporting the transverse support relative to the stanchions, said installation support means comprising a pair of substantially L-shaped members, each of said L-shaped members being secured to a rear face of an individual one of the upper members proximate to the upper distal end thereof.

7. The new portable curtain rod support of claim 6, wherein said mounting plates are positioned laterally outward relative to the stanchions such that the curtains effectively conceal the stanchions.

* * * * *